US005704610A

United States Patent [19]

Goldfarb et al.

[11] Patent Number: 5,704,610

[45] Date of Patent: Jan. 6, 1998

[54] COMPETITIVE TABLE-TOP GAME WITH ACTION-DISCHARGE

[75] Inventors: Adolph E. Goldfarb, 1432 Eastwid Cir., Westlake Village, Calif. 91361; Martin I. Goldfarb, Santa Monica, Calif.

[73] Assignee: Adolph E. Goldfarb, Northridge, Calif.

[21] Appl. No.: 796,713

[22] Filed: Feb. 6, 1997

[51] Int. Cl.[6] ..... A63B 71/04

[52] U.S. Cl. ..... 273/108; 273/118 R; 273/119 B; 273/127 R; 273/126 R

[58] Field of Search ..... 273/108, 118 R, 273/119 R, 119 B, 126 R, 127 R, 349, 459

[56] References Cited

U.S. PATENT DOCUMENTS 3,843,127 10/1974 Lack ..... 273/349
4,412,680 11/1983 Zorn ..... 273/349
4,998,729 3/1991 Lischerelli ..... 273/118 R X
5,195,751 3/1993 Senart ..... 273/459 X
5,368,300 11/1994 Becker ..... 273/119 R X
5,516,102 5/1996 Polk, III et al. ..... 273/119 R

*Primary Examiner*—Raleigh W. Chiu
*Attorney, Agent, or Firm*—Ashen & Lippman

[57] ABSTRACT

A competitive table top type game having a "fenced-in" playing surface with opposed player ends. Each player controls one or more strikers and uses it to cause a play piece such as a ball to hit the opponent's target. When a player's target is hit, a liquid discharge is directed at that player for added play value and enjoyment. For simplicity and economy of construction, that player actuates a mechanical stop to stop the discharge and reset the target. In one form, the actuation of the stop also advances the opponent's's score. Alternatively, any simple score indicating arrangement may be used.

28 Claims, 7 Drawing Sheets

40
32
50
82
88
76
74
48
78
70
72
79
84
86
42
80
100
98
94
90
102
96
92
48
40
48
78
79
82
72
70
76
84
32
86
74
50
48

COMPETITIVE TABLE-TOP GAME WITH ACTION-DISCHARGE

BACKGROUND OF INVENTION

Children love competitive action games that involve a degree of suspense and excitement. Often in such games, at some point an action occurs such as a light going on or a siren going off or something falling down. Children also enjoy participating in and causing the action and/or trying to prevent the action. There is further play value in having to react or do something once the action takes place.

SUMMARY OF ILLUSTRATED APPARATUS EMBODYING THE PRESENT INVENTION

The drawings illustrate several forms of the invention.

In one form there is a generally rectangular playing surface surrounded or fenced in by a peripheral rail or wall. The wall serves to maintain a play piece in the form of a ball on the playing surface. In this illustrated apparatus, a target is situated at each end of the playing surface to be engaged by the play piece to thereby initiate an action. At either side of each illustrated target there are two flippers operated by one of the competing players, both to protect the adjacent target from being hit by the play piece, and also to attempt to propel the play piece to the opposite end of the play surface to engage the opponent's target. In the illustrated device, the playing surface is elevated midway between the player ends and slopes slightly downwardly toward each end so the play piece will always roll back toward one or other set of flippers.

When the play piece engages a target, a stream or spray of liquid such as water is directed at the player at that end of the playing surface. That player can stop the liquid flow by operating a mechanical stop member. This also resets the target.

The apparatus provides a great deal of fun and play value. Each player tries to hit the other's target and to protect his or her own. When your target is struck you are suddenly sprayed with water, you react as quickly as possible to stop the spray, and the game continues nonstop.

In one form of the apparatus, hitting the stop member to stop the spray also automatically increases the score of the opponent.

IN THE DRAWINGS

DETAILED DESCRIPTION OF THE DRAWINGS

Figure 1:
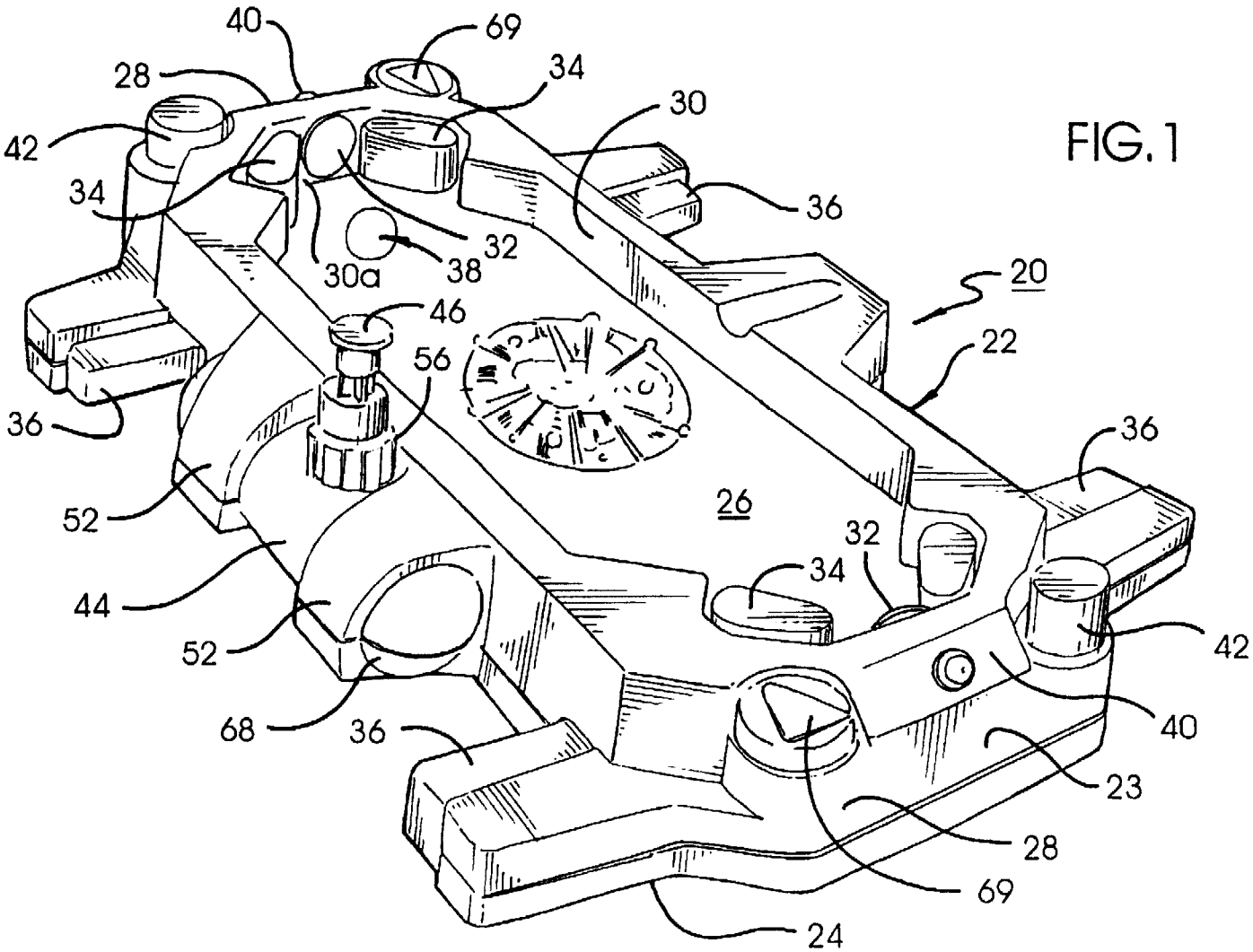
FIG. 1 is a perspective view of a table top game embodying a presently preferred form of the invention.

FIG. 1 illustrates a presently preferred form of game apparatus 20 which embodies the present invention. Apparatus 20 includes a base 22 for resting on a table, the floor or other surface. The base 22 may be constructed or molded from any suitable material such as plastic which is reasonably strong and durable and resistant to water that is used with the apparatus.

The base 22 is generally rectangular having a generally flat bottom or support surface 24. The base 22 is formed with an upwardly facing generally horizontal generally rectangular playing surface 26 having opposing player ends 28. The playing surface 26 is fenced in or enclosed along its periphery by upstanding side walls 30. The illustrated playing surface is shown as open, however, it might be provided with a transparent cover made of plastic, glass or the like.

At each player 28 end of the playing surface 26, a target or trigger 32 is provided at the center of the adjacent upright wall 30a. To either side of each centrally located target 32, one of a pair of manually operable strikers or flippers 34 is movably mounted on the playing surface 26. Manually operable actuating levers 36 for operators for the flippers 34 extend to either side from that end 28 of the apparatus.

At each end 28, the base 22 forms a housing 23 which contains mechanism to be described in detail below. Each end 28 of the illustrated apparatus 20 provides a player area or station for one of the opposing competing players. The player positions herself centrally at that end 28 and can use both hands to operate the associated flipper actuating levers 36.

One or more play pieces, such a ball 38, are disposed on the playing surface 26. As noted above, the surface 26 is slightly elevated in the center and inclined downwardly toward either end. This causes the ball 38 to roll to one end or the other, where it can be struck by a player's flippers 34.

At each end 28 there is a discharge or spray nozzle 40 directed outwardly toward the location where the adjacent player is positioned. When the play piece 38 strikes a player's target 32, this activates a mechanism which causes a spray or stream of liquid such as water to be discharged from the nozzle 40 toward the player. The player can stop the stream by quickly pressing down a stop member in the form of a pressable button 42. This also serves to reset the target 32 for the next hit.

Figure 2:
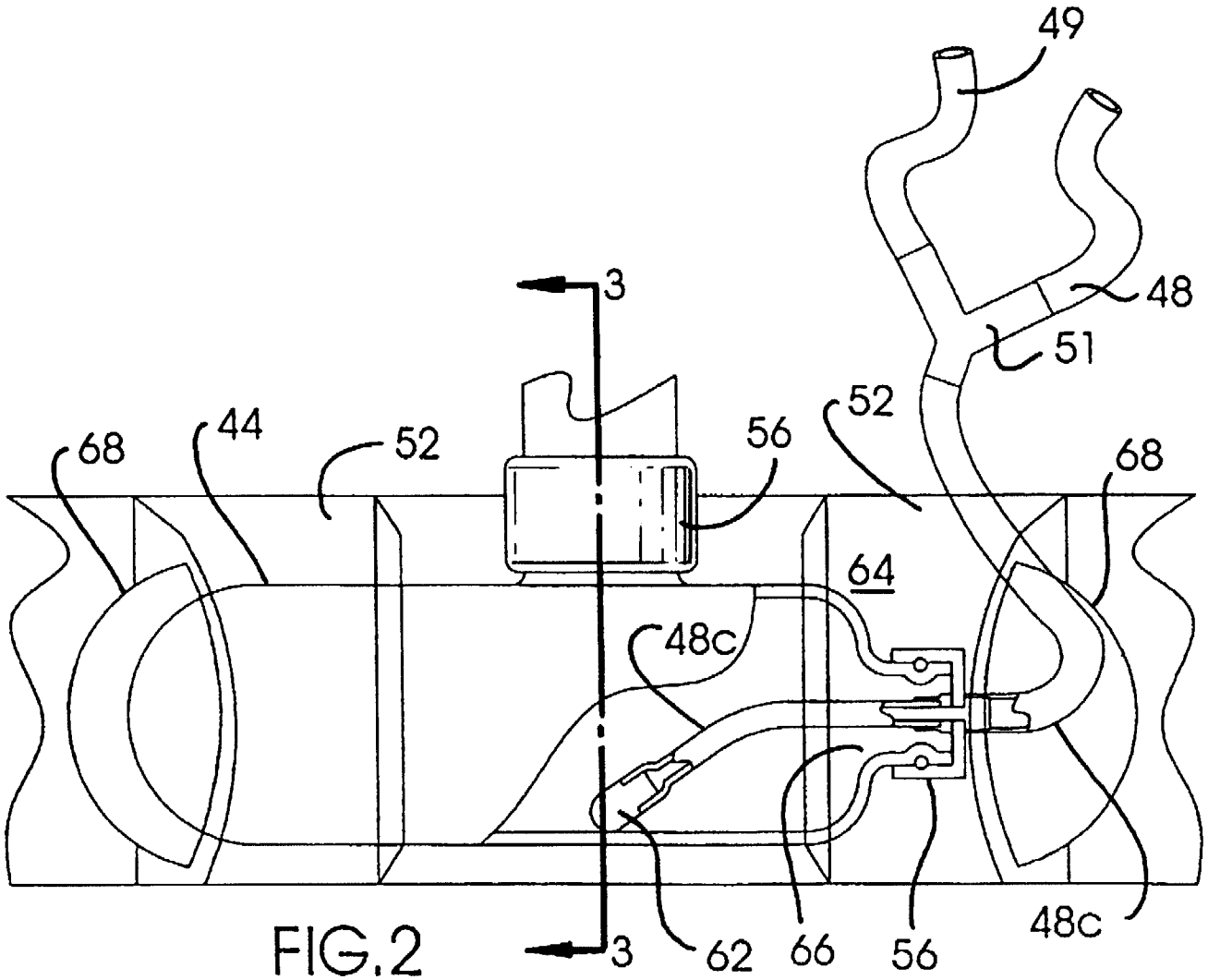
FIG. 2 is an enlarged side view, with portions broken away, of the pressurized liquid tank of the game of FIG. 1.
Figures 4, 5, 6:
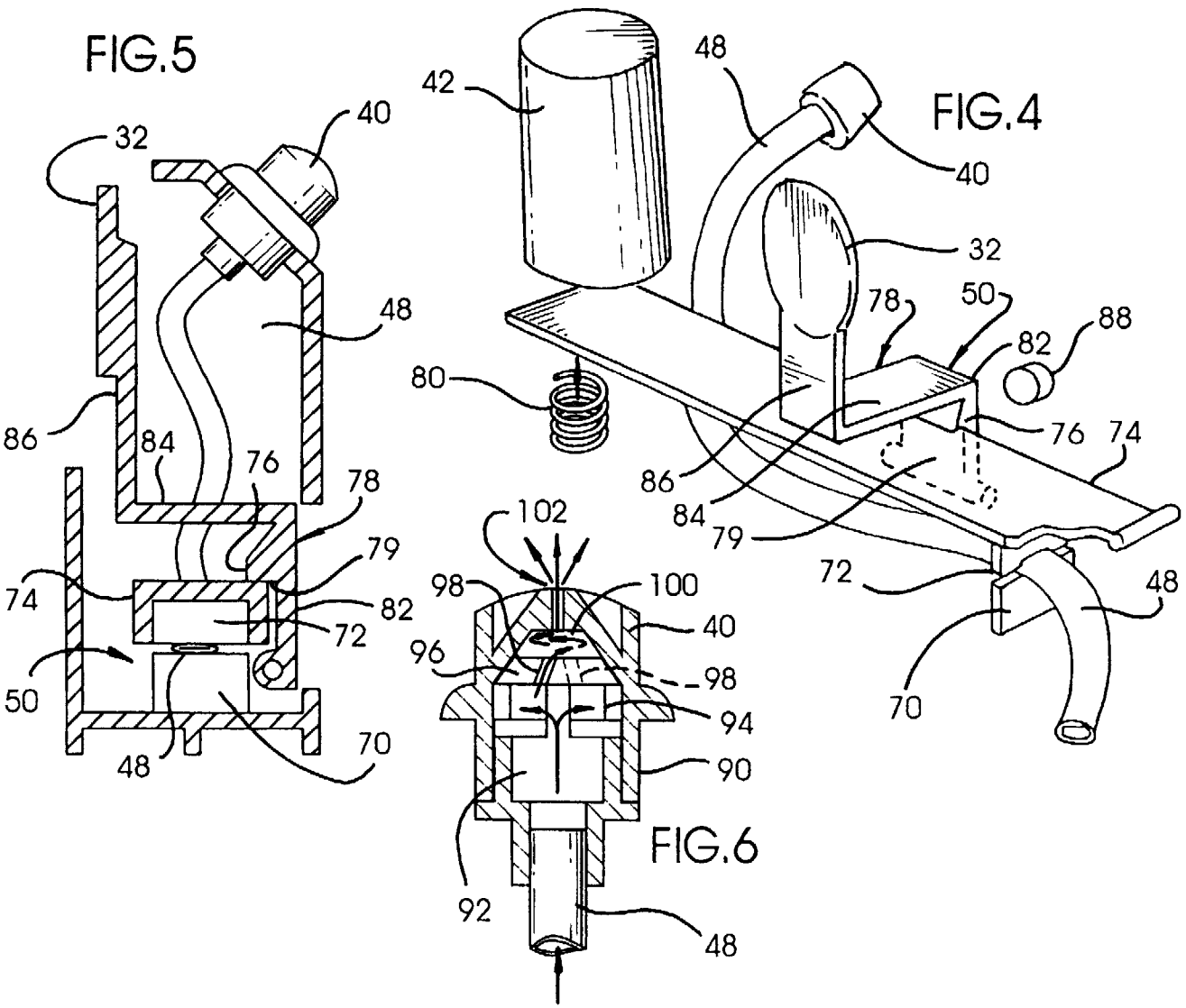
FIG. 4 is a schematic perspective view illustrating the portion of the apparatus for controlling flow from a spray nozzle.
FIG. 5 is a further enlarged side sectional view illustrating a spray nozzle, a target and related portions of the game apparatus of FIG. 1.
FIG. 6 is a sectional view of the spray nozzle of the apparatus of FIG. 1.

The illustrated apparatus 20 is provided with a refillable liquid tank 44 along one side. The tank 44 has a pump mechanism 46 which the players actuate to apply pressure to the liquid in the tank. As shown in FIGS. 2, 4 and 5, a pair of hoses or lines 48, 49 respectively connect the tank 44 to each of the nozzles 40 at the ends 28 of the apparatus. The hoses 48, 49 are flexible and each normally closed by a clamp mechanism 50 (FIGS. 4 and 5) to prevent discharge from the nozzles 40. When the play piece 38 hits a target 32, the associated clamp mechanism 50 is released and the water under pressure is sprayed from the nozzle 40 at the adjacent player. When the button 42 is depressed, the hose 48, 49 is again clamped shut by the associated clamp mechanism 50 to await the next hit of the target 32.

Figure 3:
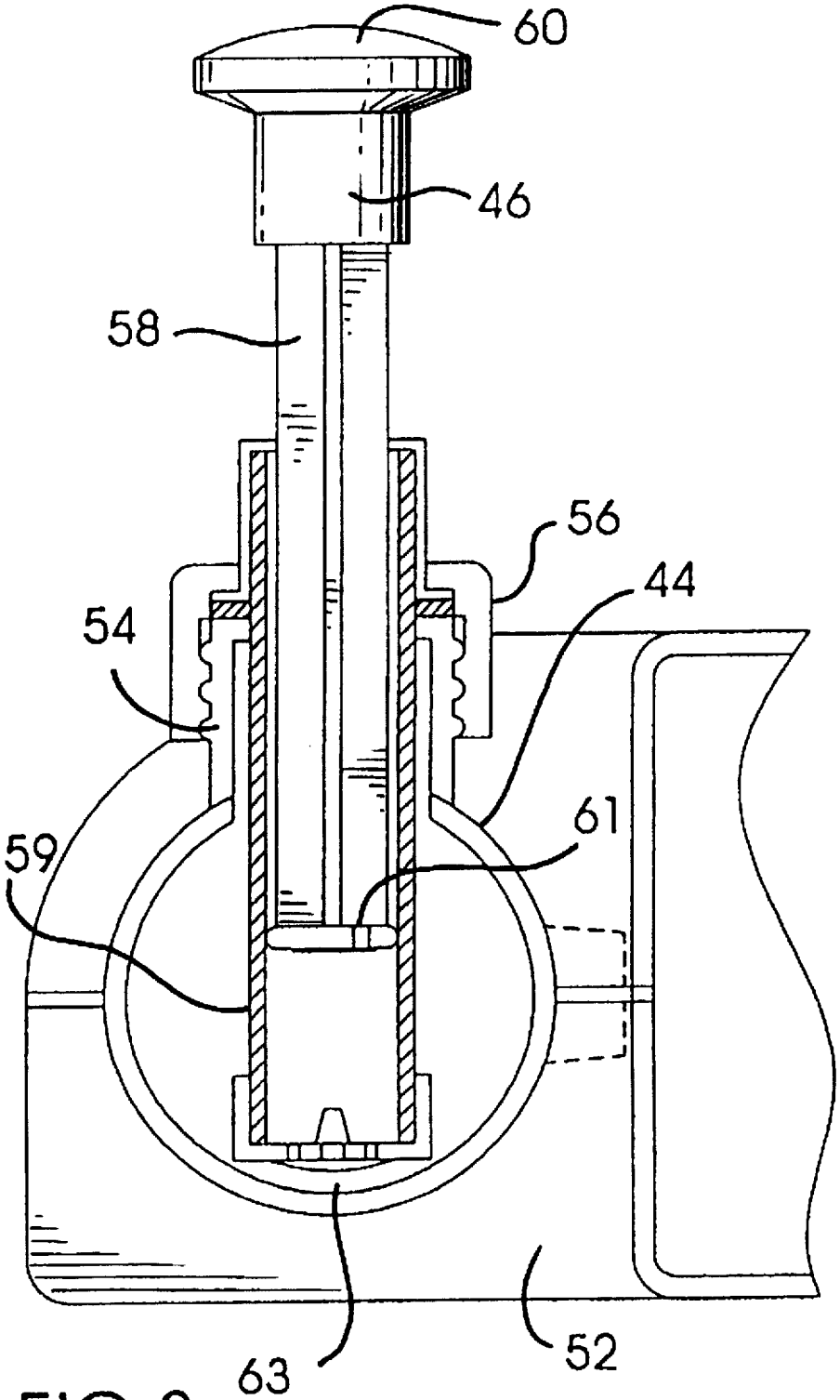
FIG. 3 is a sectional view taken generally along Line 3—3 of FIG. 2 illustrating the pump mechanism.

FIGS. 1, 2 and 3 best illustrate the pressurized tank 44. The tank 44 is a generally elongated cylinder supported in a horizontally extending position at one side of the apparatus base 22 by a pair of brackets 52. An upwardly extending externally threaded cylindrical inlet port 54 (FIG. 3) is provided at the top center of the tank 44 of refilling it with water. An internally threaded closure cap 56 normally screws onto and closes the inlet port 54. The cap 56 supports a conventional air pump mechanism 46, that extends down into the tank when the cap is mounted on the inlet port 54, for introducing air under pressure into the tank 44 to pressurize water in the tank.

As shown best in FIG. 3, the pump mechanism 46 includes a vertically reciprocating plunger 58 with a handle 60 at its upper end which is operated by manually reciprocating it up and down repeatedly. The pump mechanism 46 is mounted on the closure cap 56 so that when the cap is screwed on the inlet port 54 the pump mechanism is held in place extending down into the tank 44. The plunger 58 is vertically movable up and down in an upright pump cylinder 59 to first force air in through a first one-way valve 61 into the cylinder and then through a second one way valve 63 into the tank 44. The players initially substantially fill the tank 44 to predetermined level, screw on the cap 56 with the pump mechanism 46, and pump the handle 60 to pressurize the water in the tank.

As shown in FIG. 2, the hoses 48, 49 join at a Y-connection 51 to a single hose 48*c* that extends into the tank 44 for receiving pressurized water. The free end of hose 48*c* may have a weight 62 to maintain that end near the bottom of the tank. The hose 48*c* extends through an end cap 64 that is securely fitted and sealed to an end port 66 of the tank. Each bracket 52 may be provided with an end dome 68.

FIG. 4 schematically illustrates a hose 48 extending to a spray nozzle 40. That FIG. 4 also illustrates how the hose 48 is clamped between a stationary clamping element 70 and a movable clamping element 72. The movable clamping element 72 is attached to an elongated generally horizontally disposed lever 74 that is pivotally supported within the associated end housing 23. The lever 74 is pivotally supported at one end for pivotal movement about a generally horizontal axis that extends generally end-to-end of the apparatus. When the lever 74 is pivoted to the downward or clamping position shown in FIG. 4, a locking lip 76 on an arm 78 that carries the associated target 32 releasably engages a locking area 79 on the lever 74 and thus holds the lever and the movable clamping element 72 in clamping position. This closes the hose 48 so no water can pass through it to the nozzle 40. A suitable spring 80 exerts upward pressure on the lever 74 to maintain the lever in contact with and latched with the locking lip 76 of the target arm 78.

The illustrated target arm 78 has a generally upright first portion 82 that carries the locking lip 76. This portion 82 is pivotally supported at its lower end in the end housing 23 for pivotable movement about a generally horizontal and transversely extending axis. The upper end of first portion 82 is connected to a generally horizontal forwardly extending second portion 84. The forward end of that second portion 84 is connected to an upwardly extending third portion 86 to which the target 32 is itself mounted. The illustrated target 32 is a generally circular disk disposed in a generally vertical upright position. As shown in FIG. 1, the targets 32 are positioned just above the level of the playing surface 26 in position to be impacted by the play piece ball 38.

Returning to FIG. 4, when the play piece 38 impacts the target 32 and moves it rearwardly, the target arm 78 is pivoted rearwardly and the locking lip 76 is moved away from the adjacent locking area 79 of the pivoted lever 74. A stop 85 is provided to limit the rearward pivot of the target arm 78. When the locking lip 76 disengages from the lever 74, the spring 80 pivots the lever upwardly to raise the upper clamping element 72 and release the hose 48 so that the water can flow through the hose and out the spray nozzle 40 at the adjacent player.

As noted above, to stop the spraying action, that player pushes the stop button 42 downwardly against the end of the lever 74 to return the lever to the locking position. Gravity pivots the target arm 78 back forwardly to reposition the locking lip 76 over the locking area 79 of the lever to hold the lever in the clamping position again. Thus, the spraying action is stopped and the target 32 is reset for the next hit, all in one action by the player.

FIG. 5 illustrates, in a side sectional view, the clamping of the hose 48, and the relative positions of the lever 74, the target arm 78 and the target 32 itself. That FIG. 5 also illustrates the position of the spray nozzle 40 which is at about a forty-five degree angle upwardly and rearwardly from the horizontal.

FIG. 6 is an enlarged detailed sectional view of the nozzle 40. Small arrows indicate water flow through the nozzle 40. The nozzle 40 is connected to and in liquid communication with the end of a hose 48. The nozzle 40 has a housing 90 with a lower entry chamber 92 that receives water from the hose 48, and an intermediate dividing chamber 94 that then receives and divides the flow of water. Next a transverse wall 96 has a pair of angled passages 98 (one shown in solid line and the other in broken line) that carry water from the dividing chamber 94 to an upper mixing chamber 100. The mixing chamber 100 communicates at its upper end with a discharge outlet 102. The flow from the angled passages 96 create a turbulent flow in the mixing chamber 100, which then emerges from the discharge outlet 102 as a diffused spray rather than a stream.

Figure 7:
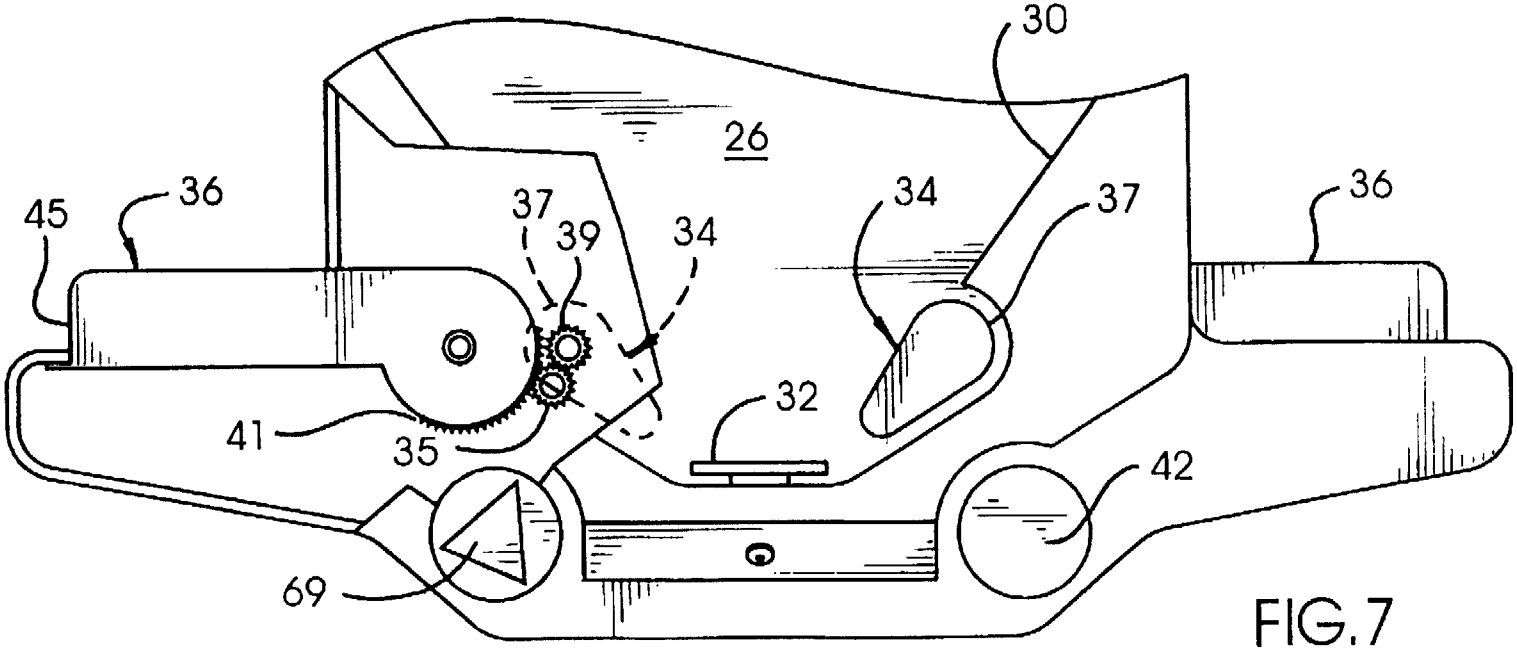
FIG. 7 is a partial view illustrating a flipper and its activating lever.

FIG. 7 illustrates schematically the mechanical arrangement between a squeezable activating lever 36 and an associated pivoted striker 34. This is a conventional arrangement where the striker 34 is pivoted at one of its ends 37 about a generally upright axis. The striker end 37 is fixed to a gear 39 that rotates with the striker. The gear 39 messes with a gear 35, which in turn messes with a segment of gear teeth 41 mounted on one end 43 of the associated lever 36. Rearward pivotal movement of the outer end 45 of the lever 36 produces rotary striking movement of the striker 34 as shown by the arrows. It will be noted that the arcs of the strikers 34 intersect some, but not all, of the routes to the adjacent target 32, particularly when the play piece bounces off of a side wall 30.

Score-keeping means may be provided in any desired form. In the illustrated apparatus 20 it is shown in FIG. 1, a simple dial 69 is provided at each end to allow each player to progressively increase their score with each hit they make.

The play of the game is simple, fun and exciting.

The ball 38 may released around the center of the playing surface 26 and it will roll toward one end or the other. The player at that end will operate his or her strikers 34 to try to impel the ball against the target 32 at the opposite end. One or more balls may be used, and the play continued until one of the targets is struck. When that happens, a spray is directed at the player from the nozzle 40 at that end. That player then reacts quickly by pushing down on her stop button 42, which stops the spray and also resets her target for further play. The other player advances her score-keeping dial 69 to show that she has scored a point. The play continues on until a determined time has elapsed or one or the other players reaches a predetermined score.

The tank 44 may be periodically refilled by unscrewing the cap 56 and filling the tank with water. The cap 56 is then removed and the pump mechanism 46 is used to pressurized the water in the tank.

Various alternative structures may be employed without departing from the spirit and scope of the present invention.

Figure 8:
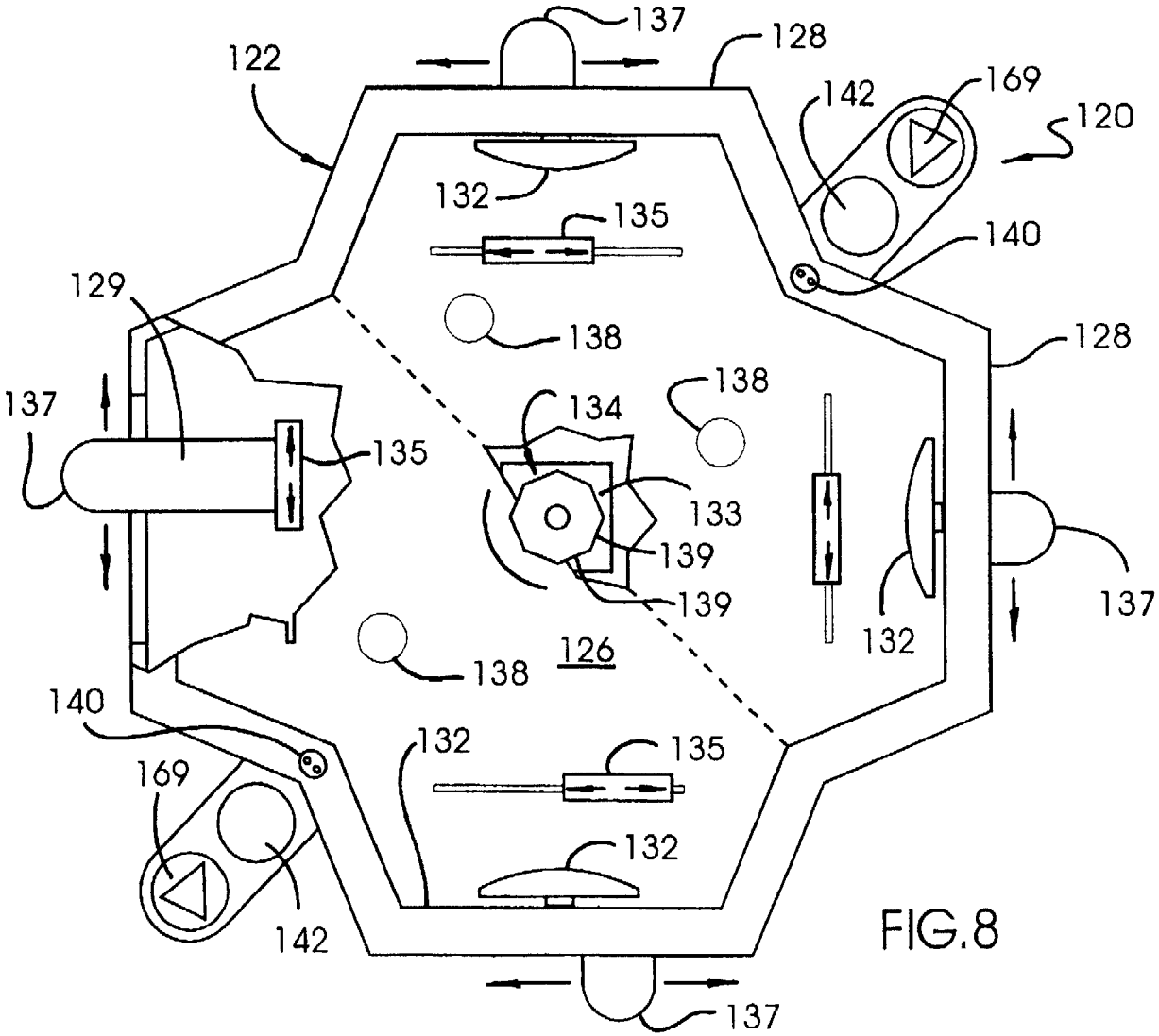
FIG. 8 is a schematic plan view of modified form of the invention with four player positions and a rotating center striker.

In this connection, FIG. 8 shows an alternate from of apparatus 120 which embodies the invention. This apparatus 120 has a base 122 with four player positions 128. The players can have teams of two against two (or lesser numbers of players can also play). Each player position 128 is provided with a target 132. Instead of manually operable flippers, there is a single strike 134 in the form of a multi-sided block mounted at about the center of the playing surface 126 for rotation about a vertical axis. This striker may be powered by any suitable source of power such as a windup or battery motor 133. This rotating center striker 134 has a plurality of flat surfaces 139 for engaging playing piece balls 138 and driving them centrifically outwardly. The playing surface 126 may be sloped downwardly into the center so that the balls 138 return to the rotating center striker. Instead of having the flippers to use defensively, each player may be provided with a shiftable shield 135 which he or she may manually manipulate using a control handle 137 to protect his or her target from play pieces directed by the center striker 134. The shield 135 may each be mounted for side-to-side sliding movement in a slot 131. The shields 135 are each connected as by a connecting rod 129 to the associated control handle 137. To increase the excitement and pace of the game, there may be a plurality of play pieces rather than a single one. Further, when a target 132 is hit, a spray may be directed not only at the adjacent player position 128 but at an additional player position (i.e., the position of partner of the player whose target was hit).

Figure 9:
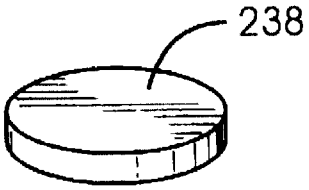
FIG. 9 is a schematic perspective view of a play piece in the shape of a flat disk.

In yet another embodiment of game apparatus shown in FIG. 9, the play piece or pieces 238 may be a slidable disk which the players hand propel.

Figure 10:
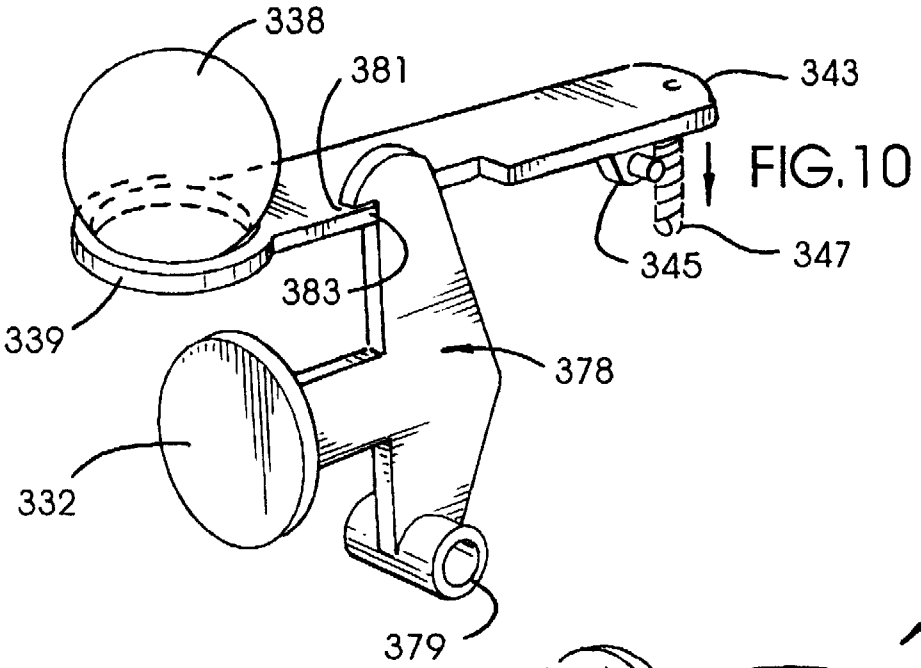
FIG. 10 is a schematic perspective view of a mechanism for discharging foam balls in a modified form of the invention.

FIG. 10 illustrates another modified form of apparatus 320 which embodies this invention. In apparatus 320, instead of discharging a liquid spray or stream, an object such as a foam ball 338 is discharged at the player whose target 332 has been hit. The ball 338 may be held in a seat formed at one end 339 of a thrower arm 341 that is pivotally mounted adjacent to its other end 343 for rotation about a shaft 345. Biasing means such as a spring 347 may be connected to the end 343 of the thrower arm 341. A pivoted latch arm 378 releasably holds the thrower arm 341 against the force of the spring 347. The target 332 is mounted on the latch arm 378. The latch arm 378 is pivotally mounted at its lower end 379 and has a latch finger 381 at its upper end. The finger 381 normally engages a latching portion 383 of the thrower arm 341 to releasably hold the thrower arm in the spring loaded or cocked position shown in FIG. 10. When the target 332 is hit by a play piece, the latch arm 378 is pivoted to disengage the finger 381 from the latch portion 383. This allows the springer 347 to pull the rearward end 343 of the thrower arm 341 downwardly, which drives the forward end 339 upwardly about shaft 345 to propel the foam ball 338 toward the adjacent player.

Figure 11:
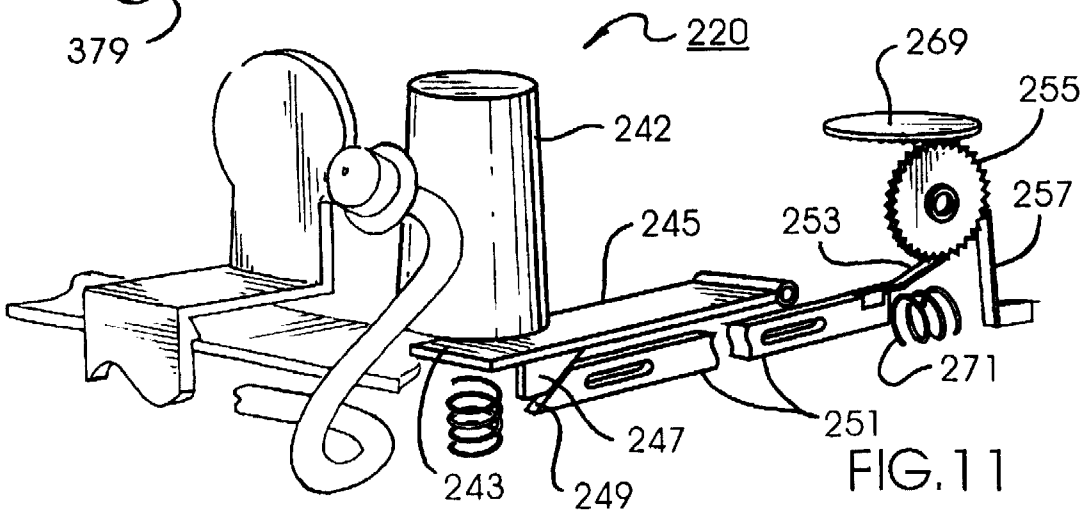
FIG. 11 is a schematic perspective view of mechanism for advancing a player's score automatically when the opponent stops the spray discharge.

FIG. 11 illustrates another modified form of apparatus 220 embodying invention. In apparatus 220, hitting either stop button 242 also automatically advances the opponent's score. This permits the game to continue at a somewhat faster pace since no time need be taken to manually advance a player score. This arrangement does add to the cost, however, for the additional mechanism.

More particularly, when either stop button 242 is pressed, it depresses the free end 243 of an associated generally horizontal pivoted arm 245. The end 243 carries a depending cam finger 245 which has an angled cam surface 247. When the end 243 is depressed, the cam surface 247 engages a second cam surface 249 at one end of an elongated horizontally extending rod 251. The rod 251 carries an elongated advancing element 253 at its opposite end 257. The advancing element 253 is positioned so that when the rod 251 is advanced by the cam finger 245, that element engages a gear wheel 255 and incrementally rotates that gear wheel. A control finger 257 engages the gear wheel 255 to limit its rotation to a predetermined increment and to prevent it from rotating back the other way. The gear wheel 255 meshes with a gear on the underside of a score-indicating disk or dial 269 that is rotatably supported in the top wall of the housing 222. The top of the dial 269 is visible to the players. Thus, each time either stop button 242 is depressed, the score-indicating dial 269 at the opposite end of the game is rotated to increase the score of the player at that opposite end. When a stop button 242 is released, a suitable return mechanism such as a spring 271 may return the associated rod 251 to the set position.

While a liquid discharge in the form of a spray is generally preferred, it may be appropriate for some uses to provide more of a single or multi-faceted stream from the nozzle, particularly when it is desired to reach a greater distance then might be achieved with a spray.

Various modifications and changes may be made in the illustrated without departing from the spirit and scope of the present invention as set forth in the following claims.

What is claimed is:

1. A competitive table top type game for two or more players comprising:

a) a generally horizontal playing surface that includes a plurality of player areas that each have an adjacent player position for a player to occupy while playing the game, b) at least one movable play piece disposed on the surface, c) a plurality of propelling mechanisms operatively located relative to the playing surface and each operable by one of the players for engaging and propelling the play piece over the playing surface, the propelling mechanism of each player being operable by that player from the player position adjacent to that player's player area, d) a plurality of targets operatively located relative to the playing surface for being engaged by the play piece, and e) a plurality of liquid discharging mechanisms each located adjacent to one or more of said player areas and operationally associated with one or more of said targets so as to discharge liquid toward one or more of player position adjacent to said one more player areas when an associated target is engaged by the play piece.

2. The game of claim 1 further including a plurality of player actuatable stop mechanisms each operatively associated with a discharging mechanism for stopping further liquid discharge from that discharging mechanism.

3. The game of claim 2 wherein each of said stop mechanisms further acts, when it is activated, to automatically reset the associated target and associated liquid discharging mechanism so that when that target is again engaged by the play piece, that liquid discharging mechanism will be actuated.

4. The game of claim 2 further including score-indicating means for each player and wherein each of said stop mechanisms also serves to automatically advance the score-indicating means of the other player.

5. The game of claim 1 further including a single source of liquid under pressure, a plurality of hoses each extending from said source of liquid to a discharge nozzle positioned at one of said player areas and directed toward the adjacent player position, said game further including a plurality of mechanical arrangements for each selectively blocking discharge of liquid from one of said nozzles, each of said blocking arrangements being operatively associated with the target at the associated player area so that when that target is engaged by the play piece, the arrangement unblocks discharge from the associated nozzle.

6. The game of claim 5 wherein said hoses are flexible and said mechanical blocking arrangements are each in the form of a clamping means that is operable to clamp shut one of the flexible hoses.

7. The game of claim 5 wherein each of said targets is movably mounted for movement between a set position and a release position, each hose being clamped shut between a pair of associated clamp arms which are releasably held in that clamped position by the associated target in its set position, movement of the associated target from its set position to its release position upon impact by the play piece serving to release the associated clamp arm to allow said clamp arms to release the associated hose to allow flow through the hose to the associated nozzle.

8. The game of claim 7 further including a pair of stop mechanisms that are each manually operable to return the associated clamp arms to the clamping position while also allowing the associated target to return to its set position to releasably hold the clamp arms in the clamping position.

9. The game of claim 1 when said play piece is a spherical ball and said generally horizontal playing surface is gradually sloped toward said player areas.

10. The game of claim 1 wherein there are two or more of said plurality of targets at each of said player areas.

11. The game of claim 1 wherein the playing surface is elongated and has opposite ends, one of said player areas being located at each of said ends, there being a single target generally in the center of each of said opposed player ends, each of said propelling mechanism being in the form of a pair of strikers at one end of said playing area, each striker of each pair being disposed at opposite sides of the associated target at the center of that end and including movable portions operable to limit access to that target.

12. A competitive table top type game for two or more players comprising:

a) a generally horizontal playing surface that includes a plurality of player areas that each have an adjacent player position for a player to occupy while playing the game, b) at least one movable play piece disposed on the surface, c) at least two targets located adjacent to said playing surface for being engaged by the play piece, and d) at least two liquid discharging mechanisms each operationally associated with at least one of said targets and designed and arranged to discharge liquid toward at least one of said player positions when a target associated with that discharge mechanism is engaged by a play piece.

13. The game of claim 12 further including at least one player actuatable stop mechanism operatively associated with at least one discharge mechanism for stopping further discharge of liquid from that associated discharge mechanism.

14. The game of claim 13 wherein said stop mechanism further acts, when it is activated operated, to automatically reset the associated target and associated liquid discharging mechanism so that, when that target is again engaged by the play piece, that liquid discharging mechanism will be actuated.

15. The game of claim 12 wherein there are two or more play pieces.

16. The game of claim 12 wherein there are three or more of said player areas.

17. The game of claim 16 wherein at least one of said discharging mechanism discharges liquid toward the player positions adjacent to at least two of said player areas.

18. The game of claim 12 wherein there is at least one target at each player area.

19. The game of claim 12 including at least one propelling mechanism operatively located and associated relative to the playing surface to engage the play piece on the playing surface and propel it over the playing surface.

20. The game of claim 19 wherein there is a propelling mechanism at each of said player areas.

21. The game of claim 19 wherein said propelling mechanism is positioned on the playing surface spaced apart from the player areas.

22. The game of claim 21 wherein said propelling mechanism is located generally centrally on said playing surface.

23. The game of claim 22 wherein said generally horizontal playing surface is inclined generally downwardly toward the propelling mechanism.

24. A competitive table top type game for two or more players comprising:

a) a generally horizontal playing surface that includes a plurality of opposed player areas each defining an adjacent position for a player to occupy while playing the game, b) at least one movable play piece disposed on the surface, c) a plurality of propelling mechanisms operatively located relative to the playing surface and each operable by one of the players for engaging and propelling the play piece over the playing surface, the propelling mechanism of each player being operable by that player from the player position adjacent to that player's player area, d) a plurality of targets each operatively located adjacent to one of said player areas for being engaged by a play piece, and e) a plurality of discharging mechanisms each located adjacent to one of said player areas, each discharging mechanism being operationally associated with the target at that player area so as to discharge an object toward the adjacent player position when the associated target is engaged by the play piece.

25. The game of claim 24 wherein said object is lightweight and without sharp edges or hard portions.

26. The game of claim 24 wherein said object is from a group comprising foam plastic and foam rubber.

27. A method of playing a competitive table top type game for two or more players, comprising the steps of:

a) providing a generally horizontal playing surface that includes a plurality of player areas that each have an adjacent player position for a player to occupy while playing the game, b) providing at least one movable play piece disposed on the surface, c) providing at least two targets located adjacent to said playing surface for being engaged by the play piece, and d) discharging liquid toward at least one player position when one of said targets is engaged by a play piece.

28. The method of claim 27 further including the step of propelling a play piece toward a target.

* * * * *